United States Patent [19]

Walter

[11] 3,957,320

[45] May 18, 1976

[54] ALL CORRUGATED TRANSFER FILE

[75] Inventor: Erhard P. Walter, Downsview, Canada

[73] Assignee: Oxford Pendaflex Canada Limited, Toronto, Canada

[22] Filed: Apr. 22, 1975

[21] Appl. No.: 570,442

[52] U.S. Cl. ..... 312/108; 229/19; 312/259

[51] Int. Cl.[2] ..... A47B 47/00

[58] Field of Search ..... 312/107, 108, 111, 259; 229/9, 19, 37–39

[56] References Cited

UNITED STATES PATENTS

| | | | |
|---|---|---|---|
| 2,095,583 | 10/1937 | Wigeland et al. | 312/108 |
| 2,121,190 | 6/1938 | Fellowes | 312/108 |
| 2,451,012 | 10/1948 | Zalkind | 312/108 |

*Primary Examiner*—Casmir A. Nunberg

[57] ABSTRACT

In a collapsible filing box comprising a sleeve containing a drawer, the sleeve is reinforced so as to require no internal liner and no support from the drawer. To this end, flaps at the front end of the side panels of the sleeve are folded upon themselves to form reinforcing pillars within the mouth of the sleeve and supporting the top panel of the sleeve, and flaps closing the rear of the sleeve extend between the bottom and top panels of the sleeve to provide further support for the latter.

8 Claims, 7 Drawing Figures

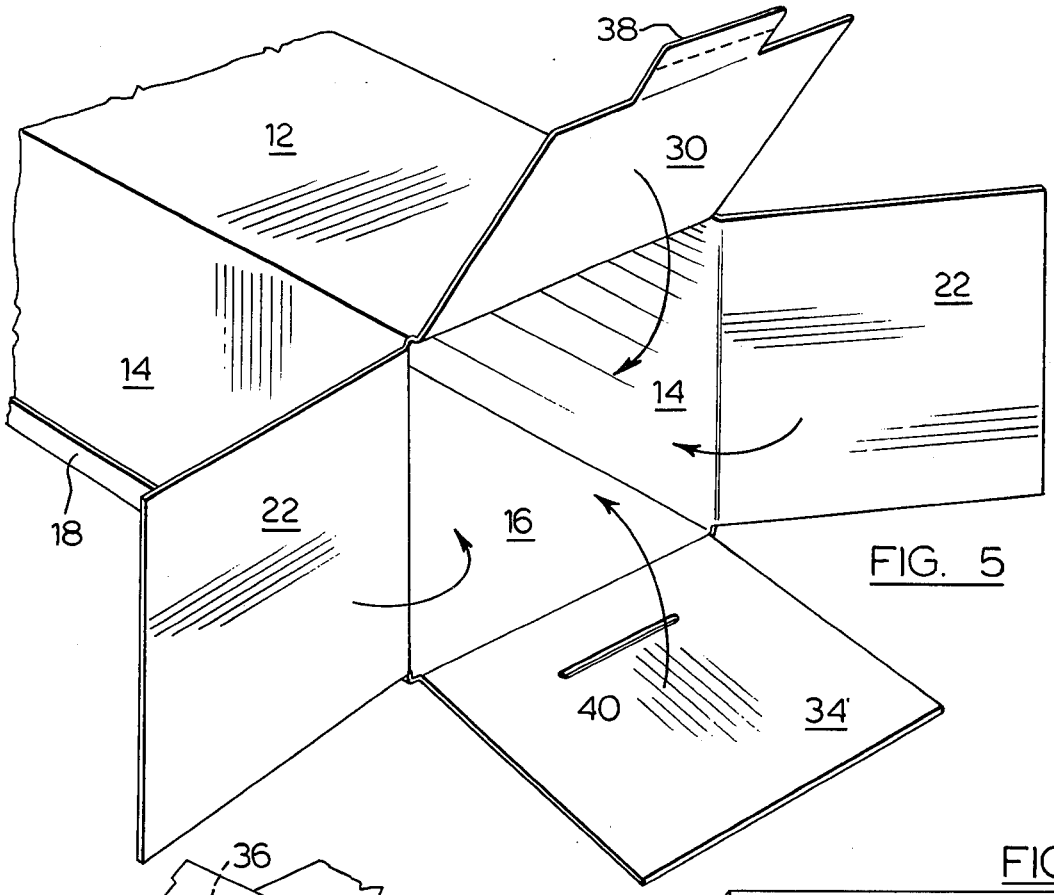
FIG. 5
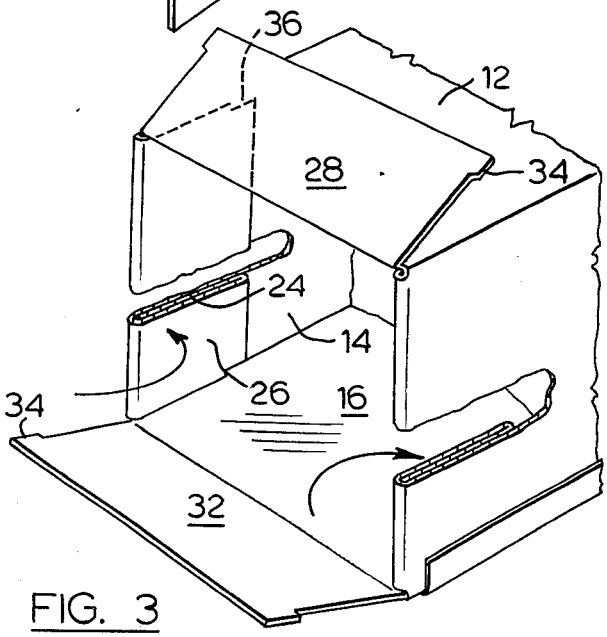
FIG. 3
FIG. 6
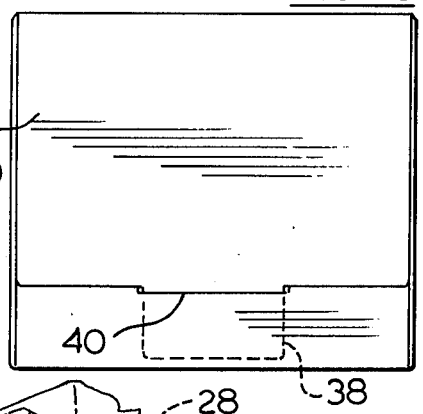
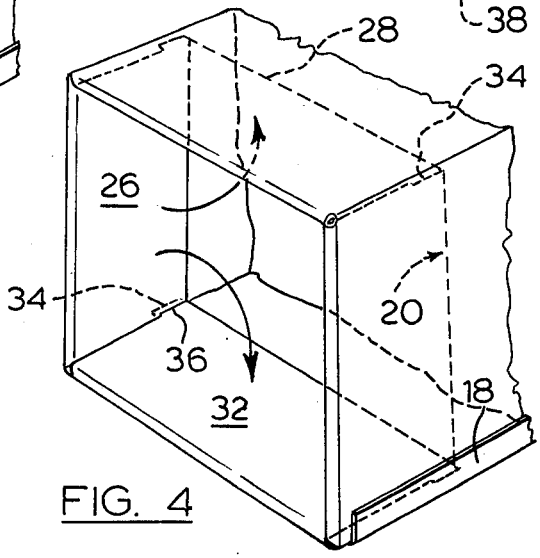
FIG. 4

ALL CORRUGATED TRANSFER FILE

FIELD OF THE INVENTION

This invention relates to collapsible filing boxes, that is to say boxes for storing files which boxes can be stored in a knocked down, flat condition until required for use.

REVIEW OF THE PRIOR ART

Filing boxes of the type which the invention relates have been developed for the storage of files to which only limited access is likely to be required, but which must be retained at least for a limited period. It is desirable that no more space be occupied by such boxes than is actually necessary to accommodate the files to be retained, and it is also desirable that the boxes be as cheap as possible in order to avoid substantial capital expenditure. For this reason, cheaply constructed box files have been developed which are assembled from corrugated cardboard blanks which can be stored flat until required for use, and thus occupy only a limited space when unfilled.

It is important that box files of the type being discussed are strong enough so that they may be stacked one upon another without files at the bottom of the stack collapsing either wholly or to such a degree as makes it impossible to withdraw the drawer portion of the file from the sleeve portion.

Various expedients have been employed in the past to overcome this problem. Firstly, it is common practice for the sleeve portion of the box to be provided with an internal liner of corrugated cardboard, this liner reinforcing the top and sides of the sleeve. Disadvantages of this technique include the additional space required to store the sleeve, the fact that a separate part is involved, the additional operation required to insert the sleeve during assembly of the box, and the fact that the reinforcement is provided over the whole length of the sleeve instead of being concentrated at the front and rear ends where it is most necessary.

Another technique involves the use of metal reinforcing frames, particularly at the front end of the sleeve. Such reinforcements add substantially to the cost of the box, and represent loose parts which are inconvenient and awkward to store as well as adding to the difficulty of assembly.

A third common technique of improving the overall strength of the box involves providing an elevated and reinforced rear (and/or front) panel on the drawer portion, which acts to support the back (and/or front) end of the sleeve when the drawer is in place. This technique has the dual disadvantages of being effective only when the drawer is in place, and tending to result in the drawer jamming in the sleeve.

SHORT DESCRIPTION OF THE INVENTION

The present invention has as its objective the provision of a collapsible filing box of comparable strength to known filing boxes, but which requires less space for storage in its knocked down condition, which requires no liner or other separate reinforcing members, and which requires no elevated rear panel on the drawer portion.

This is achieved by providing the front ends of the side panels of the sleeve portion of the box with flap members which are folded at least once upon themselves and tucked into the mouth of the sleeve to form supporting pillars for the front end of the top of the sleeve. The rear end of the sleeve is preferably formed by turned in flaps of at which at least three form direct supports extending between the top and bottom panels of the sleeve.

BRIEF DESCRIPTION OF THE DRAWINGS

A preferred embodiment of the invention is described with reference to the accompanying drawings, in which:

FIG. 1 is a perspective front view, from above and one side, of a filing box in accordance with the invention, with the drawer shown withdrawn from the sleeve portion, FIGS. 2, 3 and 4 are corresponding perspective views of the front end of the sleeve portion, showing its front flaps unfolded, partly folded and fully folded respectively, FIG. 5 is a perspective rear view of the rear of the sleeve portion, with its rear flaps unfolded, FIG. 6 is a rear elevation of the sleeve portion with its rear flaps folded.

In FIGS. 1 and 3, parts of the sleeve portion are cut away to show its construction more clearly.

DESCRIPTION OF THE PREFERRED EMBODIMENT

Figures 1, 2:
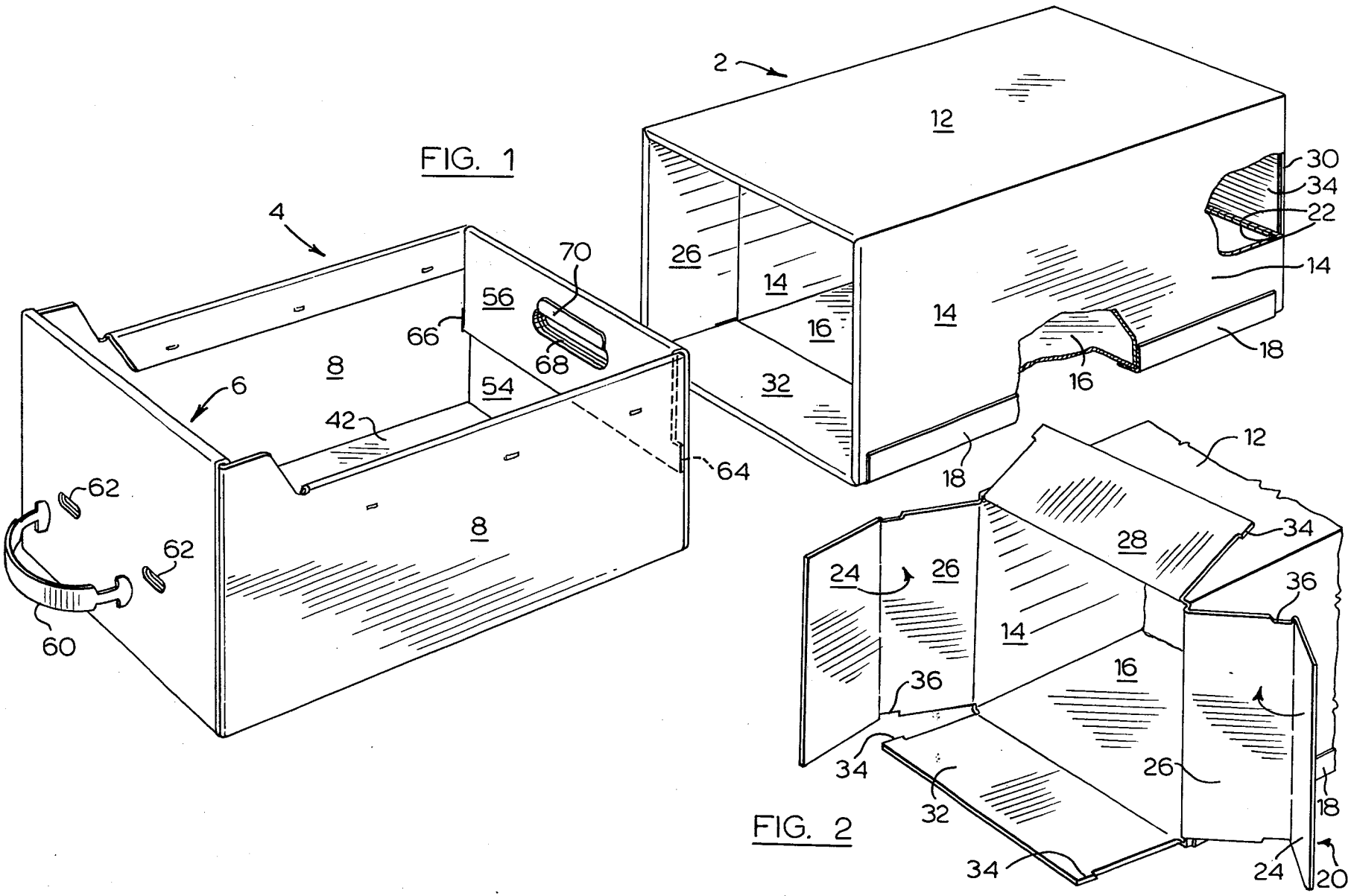

FIG. 1 shows a filing box in accordance with the invention, the box comprising a sleeve 2 and a drawer 4 which may be inserted within the sleeve. The sleeve is open at its front end and closed at its rear end, whilst the drawer has a front panel 6 dimensioned to close the front opening of the sleeve, and side and rear panels 8 and 10 somewhat lower than the front panel. The construction of the drawer is discussed more fully below with reference to FIG. 5, but it should be understood that the important features of the invention are incorporated in the sleeve 2, and other forms of drawer may be employed. In particular, although it is an advantage of the present invention that a drawer with a rear panel 10 having a height less than that of the front panel may be employed, thus reducing the chances of the drawer sticking during withdrawal or insertion, known forms of drawer having full height rear panels may also be employed.

The sleeve 2 (see FIGS. 1 through 6) is formed from a rectangular blank of corrugated cardboard folded to form a tubular sleeve having a top panel 12, side panels 14 and a base panel 16, the sleeve being completed by a sealing strip 18 connecting the edges of two of the panels. The panels each carry flaps at their front and rear ends. In the case of the side panels 14, there are front end flaps 20 and rear end flaps 22, the front end flaps 20 being foldable into two subflaps 24 and 26.

The top panel has a front flap 28 and a rear flap 30, whilst the bottom panel has a front flap 32 and a rear flap 34. When the sleeve is in knocked down condition, the panel 16 and one of the panels 14 overlie the panel 14 and the panel 12, with the various flaps projecting outwardly from and in the same plane as their associated panels. Thus the knocked down sleeve is nowhere more than two thicknesses of cardboard thick.

In order to erect the sleeve, the panels are moved into their correct juxtaposition and the flaps folded into place about fold lines, commencing at either end. Assuming that the flaps at the front end are first to be folded, the flaps 20, which are the same height as the side panels are each folded upon themselves (see FIG. 2) about fold lines parallel to the fold lines connecting them to the side panels so that the subflaps 24 and 26 overlie one another, and the resultant double folded flaps are then tucked into the open end of the sleeve as shown in FIG. 3. The flaps 28 and 32 are then also folded inwards and tucked into the open end of the sleeve, tongues 34 on these flaps entering notches 36 formed in the flaps 26 so as to engage the latter and hold them in position (see FIG. 4).

At the rear end of the sleeve, the flaps 22, which have the same dimensions as the internal cross-section of the sleeve are folded inwards (see FIG. 5) so as to extend between the panels 12 and 16, and the flaps 34, which is also of the same dimensions as the cross-section of the sleeve is folded inwards to overlie the flaps 22. The panels are secured in place by folding the flap 30 to overlie the flap 34 and tucking a subflap 38 on the flap 30 into a slot 40 in the flap 34. In an alternative arrangement the flap 30 could be attached to the bottom panel and the flap 34 to the top panel.

It will thus be appreciated that at the front end of the sleeve, the panel 12 is supported not only by the side walls 14, but also by columns (see FIG. 3) within the open mouth of the sleeve formed by the double folded subflaps 24 and 26, which not only serve to strengthen the front end of the sleeve against vertically imposed loads, but also reinforce it against general wear and tear caused by the insertion and withdrawal of the drawer portion of the box.

At the rear of the sleeve, the panel 12 is supported not only by the walls 14, but by the two flaps 22 and the further flap 30, all of which are of full width and directly supported by the base panel 16.

This strengthening at the front and rear of the sleeve enables it to withstand vertically imposed loads without having to rely on metal reinforcements or separate liners, and without relying on support from the drawer portion.

Figure 7:
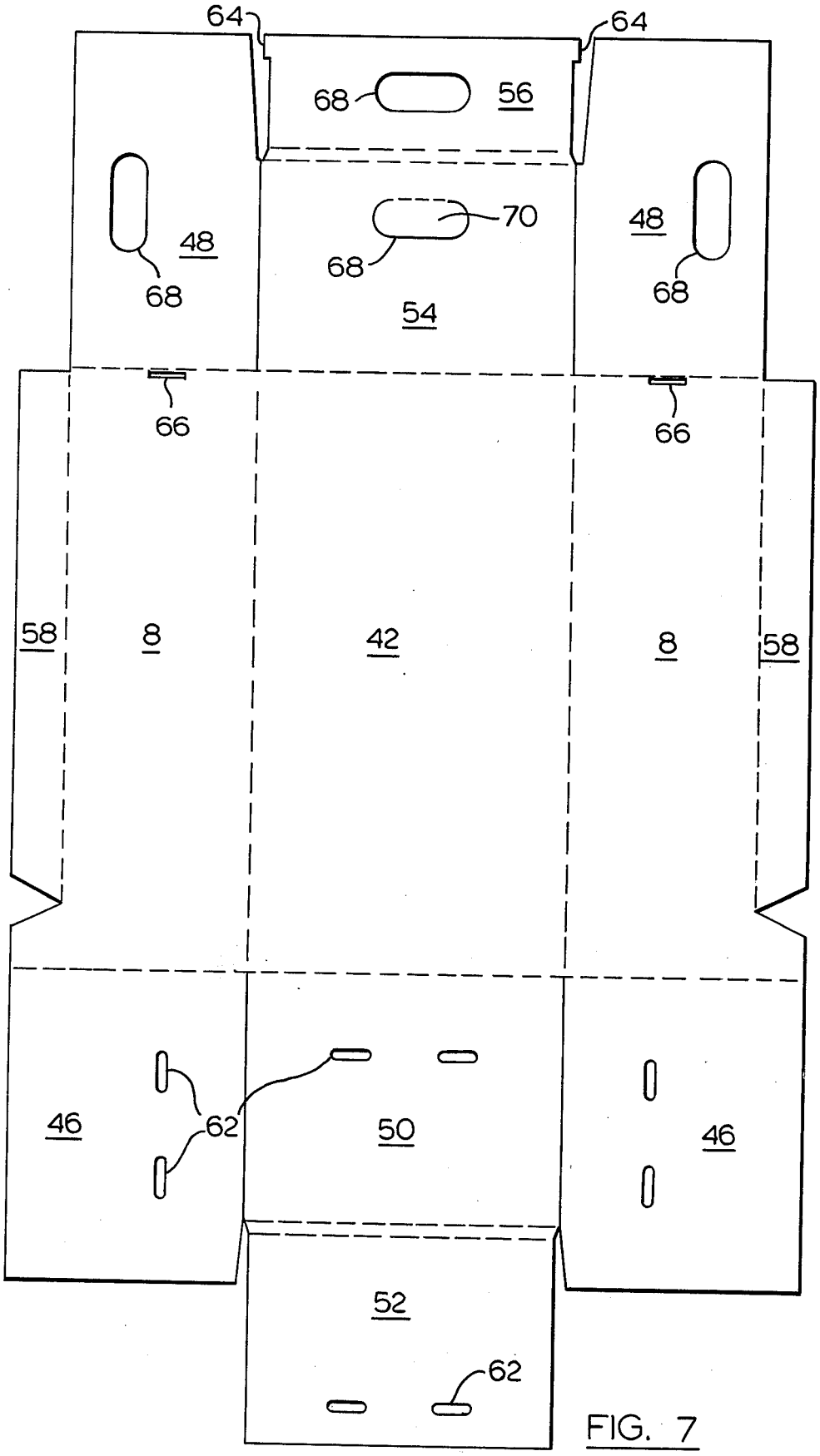
FIG. 7 shows a plan view of the drawer in knocked down condition.

A one piece blank which can be assembled into a suitable form of drawer is shown in FIG. 7. It is formed with cuts and fold lines so as to provide a base panel 42, and the side panels 8. Each of the panels is formed with flaps at each end, in the case of the side panels front flaps 46 and rear flaps 48, and in the case of the base panel front flaps 50 and 52 and rear flaps 54 and 56. The side panels 8 also have turned down edge flaps 58 to provide additional reinforcement to the side edges of the drawer.

To assemble the drawer, the side panels 8 are folded inwardly into a vertical position relative to the bottom flap 42, the flaps 46 are each folded inwardly so as to lie adjacent one another, the flap 50 is folded upwardly in front of the flaps 46, and the flap 52 is then folded downwardly over the top of the flaps 46 towards the base panel 42. The panels 46, 50 and 52 are then secured together to form the front panel 6 by the insertion of a handle 60 through slots 62 formed in the flaps so as to be in register when the flaps are folded as described above.

At the rear of the drawer, the flaps 48 are folded inwardly so as to lie against one another, the flap 54 is folded upwardly so as to lie against the flaps 48, and the flap 56 is then folded downwardly over the flaps 48 and into the interior of the drawer so that tongues 64 enter slots 66 formed in the panels 8. Openings 68 in the flaps 48, 54 and 56 are positioned so as to be in register when the flaps are folded to form the rear panel 10 and provide a hand hold to facilitate carrying of the drawer. In the case of the opening 68 in the panel 54, an undetached flap 70 is provided which renders the hand grip more comfortable.

Various modifications of the box are possible. As mentioned above, different designs of drawer may be employed, and as a further possible variation, the flaps 20 may be formed with more than two subflaps which are folded one upon another to provide yet further reinforcement at the front end of the sleeve.

What I claim as my invention is:

1. A collapsible box file comprising a sleeve portion and a drawer insertable within the sleeve portion wherein both the drawer and the sleeve portion are formed by fold corrugated cardboard blanks, the blank forming the sleeve portion having opposite edges attached to form a tubular sleeve having top, side and bottom panels each with front and rear flaps, the rear flaps being folded into a common plane to close one end of the sleeve, and the front flaps being folded into the interior of the front end of the sleeve to engage one another, those front flaps attached to the side panels being additionally folded upon themselves at least once to form supporting pillars comprising at least two thicknesses of cardboard extending between the top and bottom panels in addition to the side panels.

2. A collapsible box file according to claim 1, wherein at least two of the rear flaps when folded extend the full height and width of the sleeve so as to support the top panel and to be supported by the bottom panel of the sleeve.

3. A collapsible box file according to claim 1, wherein said at least two flaps comprise those attached to the side panels, the rear flaps attached to the top and bottom panel being folded over one another overlying the side panel rear flaps and interlocked to maintain the rear of the sleeve in a closed condition.

4. A collapsible box according to claim 3, wherein said at least two flaps also include that one of the top and bottom panel rear flaps which underlies the other.

5. A collapsible box according to claim 1, wherein the front flaps on the top and bottom panels have tongues engaging slots in the folded front flaps of the side panels.

6. A collapsible box file according to claim 1, wherein the drawer has a base panel and front, rear and side panels, the front panel being of the same dimensions as the cross-section of the sleeve portion, and the rear and side panels being lower than the front panel.

7. A knocked down box file comprising a tubular sleeve having top, side and bottom panels and collapsed so that the top and one side panel overlie the other side and the bottom panel, front and rear flaps extending from each of the panels and connected thereto at fold lines, the front flaps on the side panels being the same height as the side panels and provided with further fold lines parallel to the fold lines connecting them to the side panels about which the flaps may be additionally folded upon themselves at least once, and the rear flaps on the side panels and one of the rear flaps on the top and bottom panels being of the same dimensions as the internal cross section of the sleeve when erected, the rear flaps on the top and bottom panels having configurations which are mutually interlockable when the sleeve is erected with the other of said rear flaps on the top and bottom panels overlying said one flap, and a blank erectable to form a drawer insertable in the sleeve when erected.

8. A knocked down box file according to claim 7, wherein the drawer blank has a drawer base panel, drawer side panels connected by fold lines to either side of the base panel, and front and rear end flaps connected by fold lines to the front and rear ends of the base and side panels, the front end flaps being foldable into interengagement to form a drawer front panel and the rear end flaps being foldable into interengagement to form a drawer rear panel, the front and rear flaps being configured so that the front panel formable by the front flaps is of the same dimensions as the sleeve when erected and the rear panel formable by the rear flaps is of lesser height than the front panel when erected.

* * * * *